US006227001B1

(12) United States Patent
Oyabu et al.

(10) Patent No.: US 6,227,001 B1
(45) Date of Patent: May 8, 2001

(54) SEPARATE TYPE AIR CONDITIONER

(75) Inventors: Keiko Oyabu; Taii Tsuji, both of Shiga-ken; Masami Hayashi, Otsu, all of (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 09/492,266

(22) Filed: Jan. 27, 2000

(30) Foreign Application Priority Data

Jan. 26, 1999 (JP) ..... 11-016347

(51) Int. Cl.[7] ..... F25D 23/12
(52) U.S. Cl. ..... 62/262; 62/259.1
(58) Field of Search ..... 62/262, 263, 259.1, 62/298; 165/47, 48.1

(56) References Cited

U.S. PATENT DOCUMENTS 5,417,279 * 5/1995 Wada .
5,669,229 * 9/1997 Ohbayashi et al. ..... 62/259.1
5,857,353 * 1/1999 Schneider et al. ..... 62/263 X

FOREIGN PATENT DOCUMENTS

411159799 * 6/1999 (JP) .

* cited by examiner

*Primary Examiner*—Corrine McDermott
*Assistant Examiner*—Chen Wen Jiang
(74) *Attorney, Agent, or Firm*—Parkhurst & Wendel, L.L.P.

(57) ABSTRACT

Fins (6) of an indoor heat exchanger (4) for an separate type air conditioner are prevented from being deflected toward the inside and deformed by an external force imposed during transport. In the separate type air conditioner comprising: an indoor unit including an indoor air intake port (2), an indoor heat exchanger (4) bent into a front portion and a rear portion, an indoor fan, an indoor air blow-off port (5), etc.; an outdoor unit including an outdoor air intake port, an outdoor heat exchanger, an outdoor fan, an outdoor air blow-off port, a compressor, etc.; and pipes and wires connecting the indoor unit to the outdoor unit to form a refrigeration cycle and an electric circuit, a spacer (9) provided on top of the bent portion of the indoor heat exchanger (4) is provided with protruding faces (10, 11, 13) so that the protruding faces (10, 11, 13) are caused to abut on the upper inside of the fins (6) on the front side and the rear side of the indoor heat exchanger (4).

5 Claims, 12 Drawing Sheets

SEPARATE TYPE AIR CONDITIONER

FILED OF THE INVENTION

The present invention relates to a separate type air conditioner used for conditioning air in a room.

BACKGROUND OF THE INVENTION

First, a construction of an indoor unit for a conventional separate type air conditioner will be described, focusing on an indoor heat exchanger, with reference to FIG. 9. The indoor unit body is configured to comprise an indoor heat exchanger 4, an air blow-off grille 5, an indoor power source plate, an air blowing fan, a fan motor and other parts, all of which are contained in a housing 3 composed of a frame 1 and a front grille 2. The indoor heat exchanger 4 comprises a plurality of fins 6 disposed in parallel, end plates 7 located on both sides, and a pipe 8 passing through the fins 6 and the end plates 7 as shown in FIG. 10. In order to increase the heat exchanging capability while keeping the compactness of the indoor unit, the indoor heat exchanger 4 is shaped so as to be bent at a plurality of places at the lower front portion and between the front portion and the rear portion as shown in FIG. 10. This bent shape is formed by a connection between a plurality of heat exchangers or a connection between some bent heat exchangers and a separate heat exchanger. Gaps developed in an indoor air circuit by disassembling and assembling the indoor heat exchanger 4 produce adverse effects such as dewcondensation. Therefore, as shown in FIGS. 11 and 12, an upper part between the front-side and rear-side heat exchangers is closed by a spacer 9, which is fixed with screws or the like.

However, the configuration of the indoor heat exchanger 4 for the conventional separate type air conditioner has a problem in that if a shock is applied to the heat exchanger 4, for example, in transport, the heat exchanger 4, i.e., the fin 6 is deflected toward the inside, with the result that there is a possibility of adverse effects caused on the performance of the heat exchanger 4.

An object of the present invention is to prevent the occurrence of deflection of the fin of the indoor heat exchanger by a deformed spacer without any increase in the number of parts.

Another object of the present invention is to prevent the occurrence of deflection of the fin of the indoor heat exchanger by a spacer without any increase in the number of parts and fabrication processes.

Still another object of the present invention is to prevent the occurrence of deflection of the fin of the indoor heat exchangers of a plurality of types by utilizing the flexibility of a spacer body while keeping the commonality thereof.

DISCLOSURE OF THE INVENTION

To solve the above problem, the present invention provides a separate type air conditioner which is provided with a spacer on top of a bent portion to close a gap caused at the upper part of an indoor heat exchanger disassembled and assembled at the upper part into the front side and the rear side, characterized in that the spacer is provided with one or a plurality of protruding faces, which are substantially perpendicular downwardly to the spacer, at the front and the rear of the lengthwise central portion of the spacer to prevent the inward deflection of fins of the indoor heat exchanger so that the protruding faces are caused to abut on the upper inside of the front-side and rear-side fins.

By this configuration, the downwardly protruding faces of the spacer is brought into close contact with the front-side and rear-side fins, so that the front-side heat exchanger and the rear-side heat exchanger form a strong integral structure against inward bending via the spacer. Therefore, even if an unexpected external force is applied to the heat exchanger, for example, in transport, the heat exchanger is formed integrally in terms of strength, and the heat exchanger has a construction such as to be supported not only by end plates at both ends but also by the spacer at a middle part having a relatively weak strength, so that the heat exchanger in accordance with the present invention has a far higher resisting force and damaged less than the conventional heat exchanger, and also the inward deflection of the fins is less.

Three modes of providing the downwardly protruding faces in contact with the fins on the spacer are disclosed in the present invention.

The spacer protruding faces of a first mode of the present invention are formed by cutting and bending downward the spacer at the front part and the rear part in the vicinity of the lengthwise central portion of the spacer. Since the cutting and bending can be performed simultaneously with the pressing of the spacer, an excess fabrication process is unnecessary, and the manufacturing manpower is not increased.

The spacer protruding faces of a second mode of the present invention are formed by forming downwardly protruding portions formed by drawing integrally with the spacer. The front and rear ends of the protrusions are used as the protruding faces. Like the above-described first mode, since the drawing can be performed simultaneously with the pressing of the spacer, an excess process is unnecessary, and the manufacturing manpower is not increased.

In addition, the spacer protruding faces of a third mode of the present invention are, unlike the above-described two modes, formed by mounting and fixing a separate part of an arbitrary shape having the front and rear end faces at a necessary place on the bottom surface of the spacer. Although the number of parts increases, the spacer body can be used commonly, being applicable to a plurality of indoor heat exchangers of different shapes, so that this mode is advantageous in terms of parts control at the time of manufacture. Also, the separate part has a very simple shape, having the front and rear end faces. Therefore, even if the separate part is excessively manufactures, it does not increase the manpower very much.

DESCRIPTION OF THE EMBODIMENTS

Figure 1:
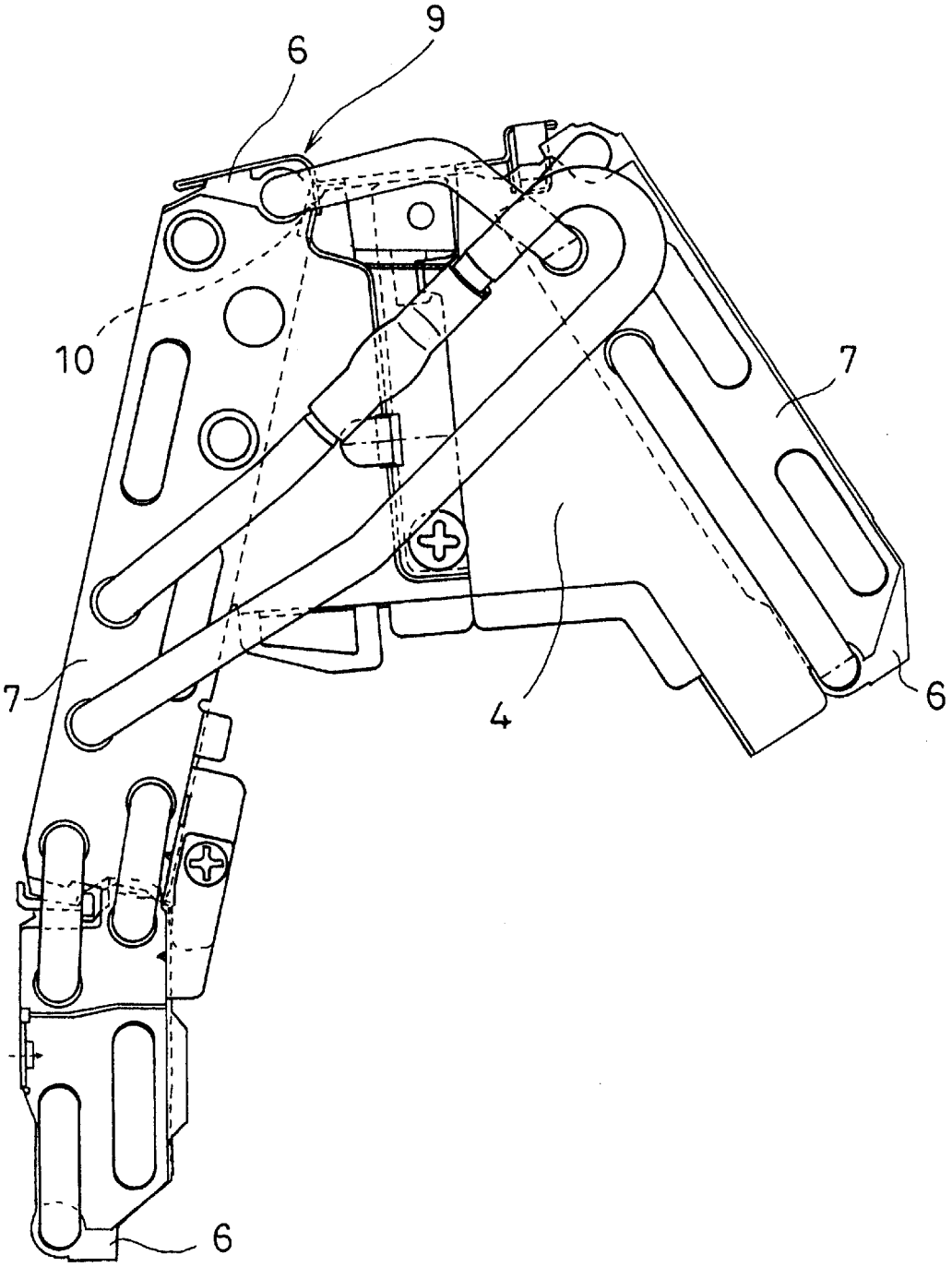
FIG. 1 is a side view of an indoor heat exchanger for a separate type air conditioner in accordance with a first embodiment of the present invention.

Embodiments of the present invention will now be described with reference to the accompanying drawings. The same reference numerals are applied to the same elements as those in the conventional example.

Figure 2:
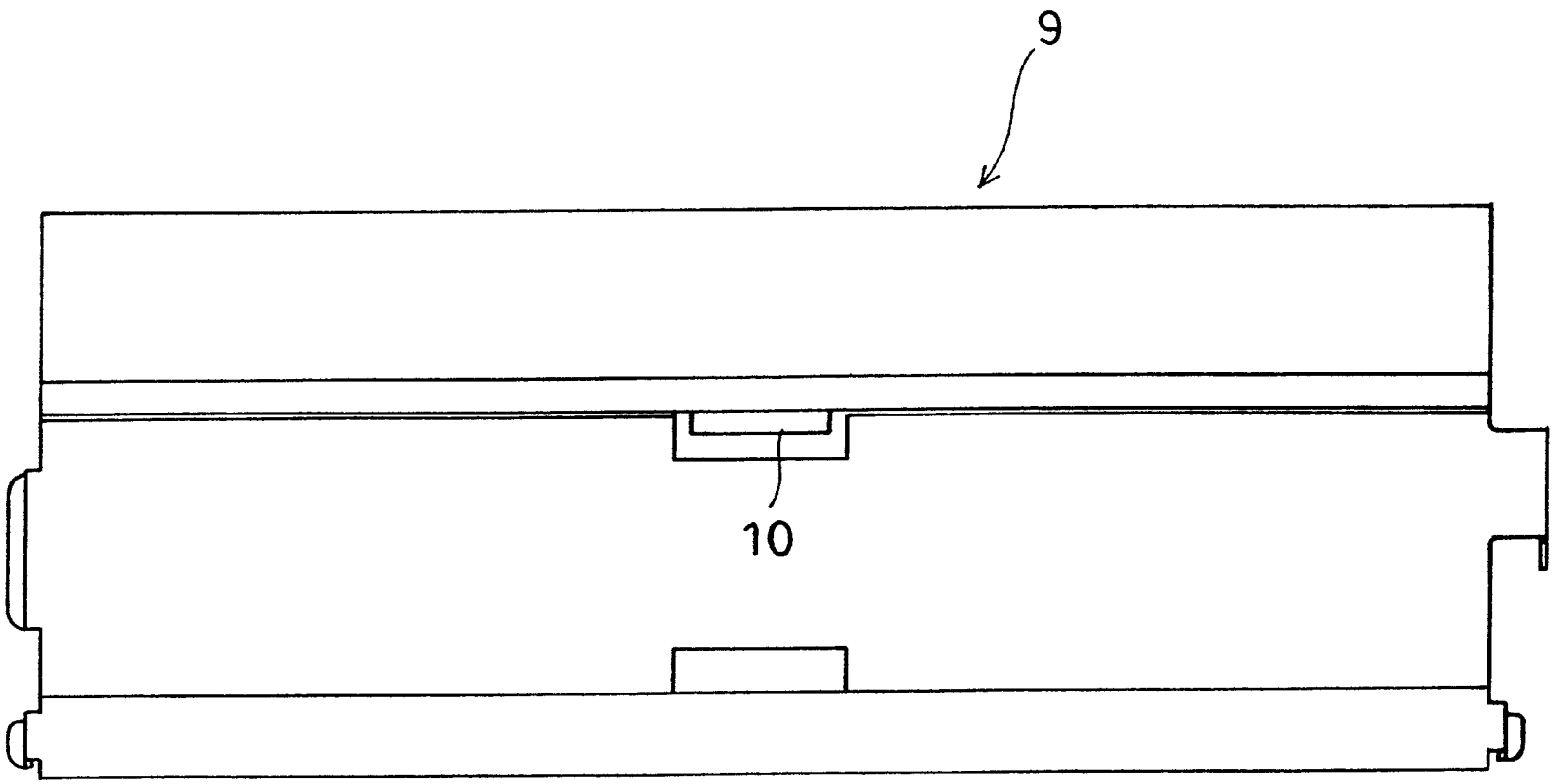
FIG. 2 is a plan view of a spacer for the indoor heat exchanger.
Figure 3:
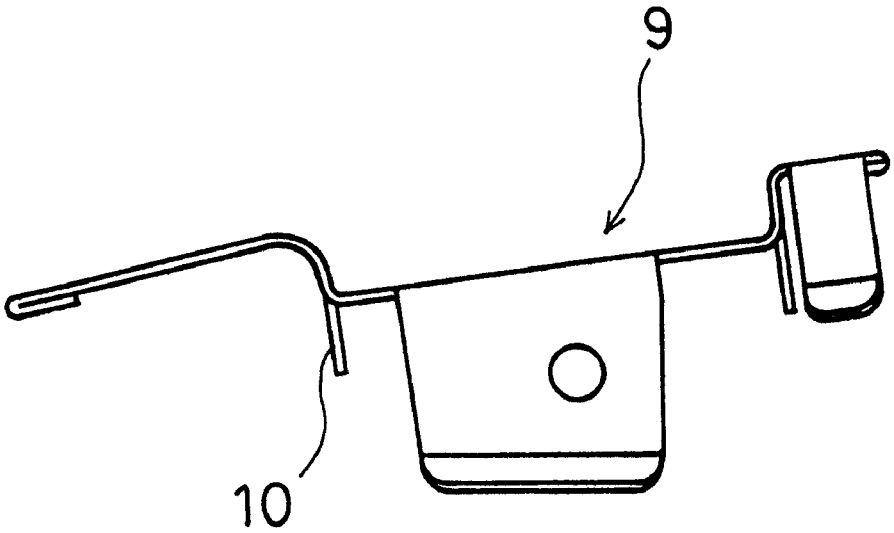
FIG. 3 is a side view of a spacer for the indoor heat exchanger.
Figure 4:
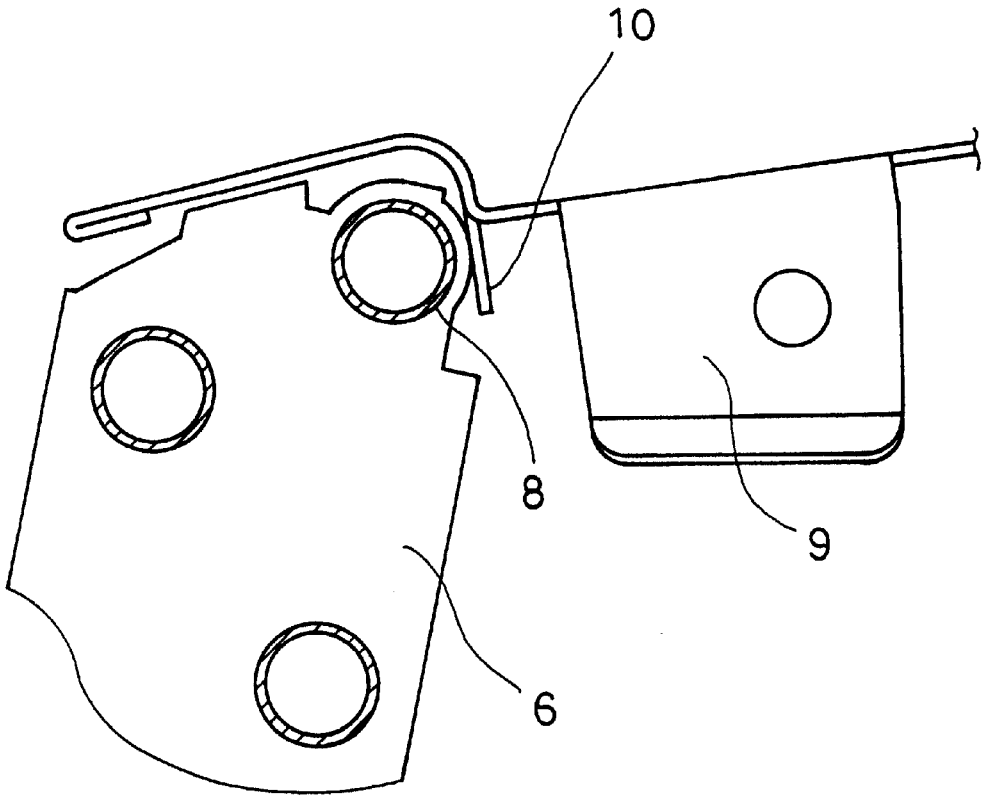
FIG. 4 is an enlarged side view of a spacer and a fin for the indoor heat exchanger.

First, an indoor heat exchanger and a spacer for a separate type air conditioner in accordance with a first embodiment will be described with reference to FIGS. 1 to 4. A spacer 9 shown in FIGS. 2 and 3 is provided so as to close an upper gap between a front-side heat exchanger and a rear-side heat exchanger. However, at a front part and a rear part of a lengthwise central portion of the spacer 9, one or a plurality of downwardly protruding faces 10 are provided by cutting and bending the part of the spacer 9 at a part located in the vicinity on the upper inside of fins 6 when the spacer 9 is mounted in the gap caused by the bent shape of the indoor heat exchanger 4. As shown in FIG. 4, the configuration is such that when the spacer 9 is mounted and fixed to the indoor heat exchanger 4, the protruding face 10 of the spacer 9 is located along the tip ends of the fins 6. Therefore, the protruding face 10 hits the fins 6 when a force is applied from the outside, so that the fins 6 are prevented from being deflected.

Figure 5:
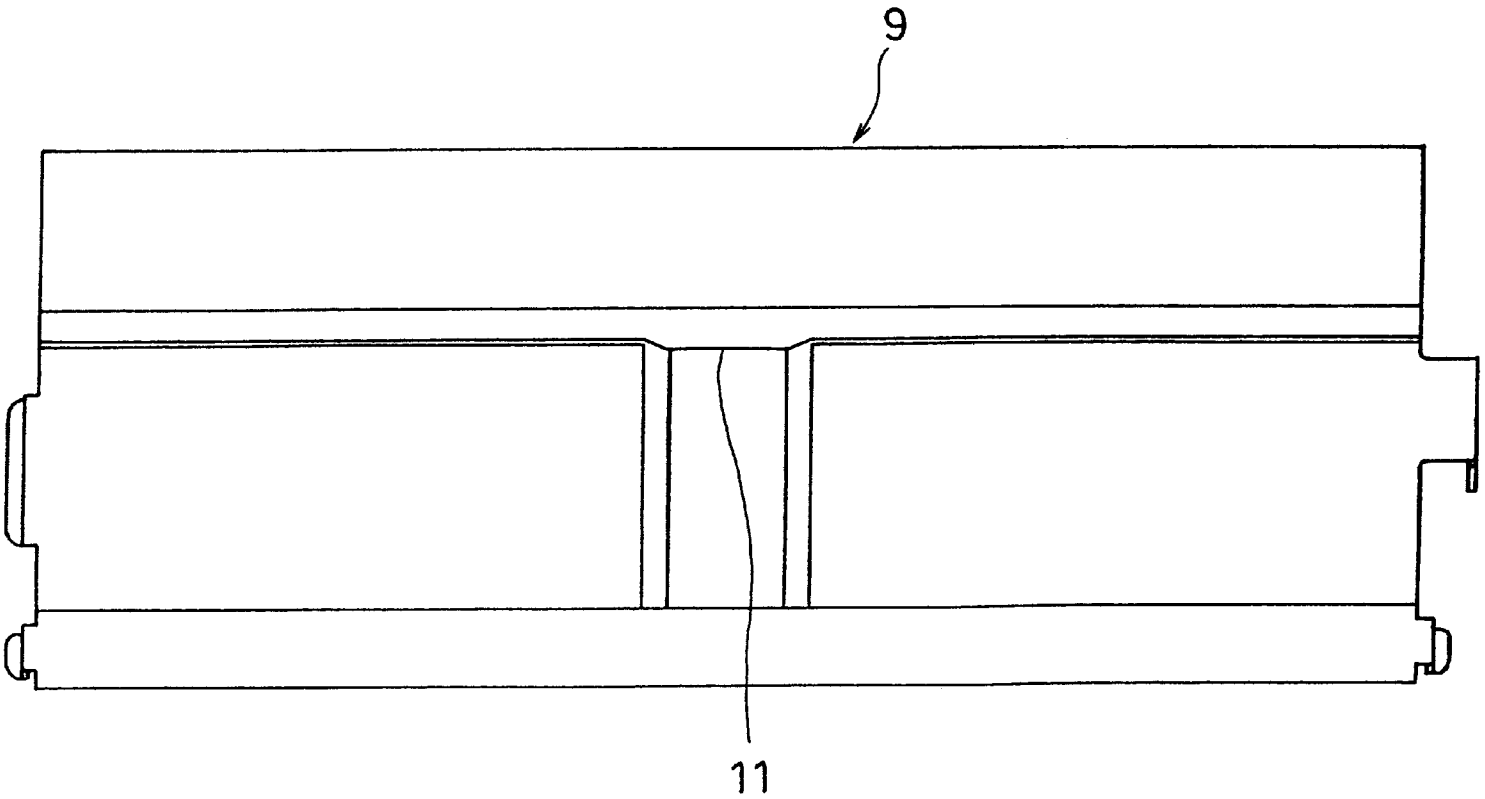
FIG. 5 is a plan view of a spacer for an indoor heat exchanger in accordance with a second embodiment of the present invention.
Figure 6:
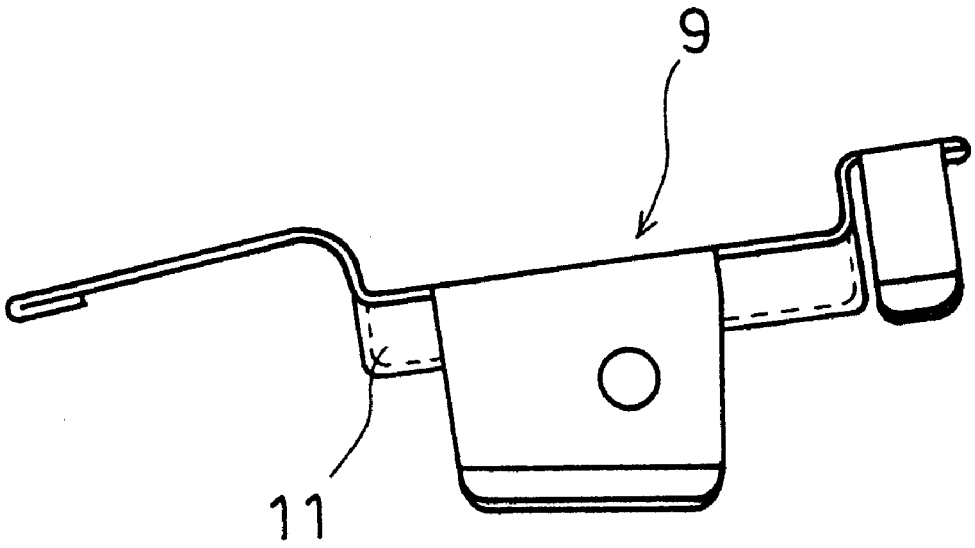
FIG. 6 is a side view of a spacer for the indoor heat exchanger.

Next, a spacer in accordance with a second embodiment of the present invention will be described with reference to FIGS. 5 and 6. A spacer 9 shown in FIGS. 5 and 6 is provided with downwardly protruding portions, which are formed by drawing, at the same position as that described in the first embodiment, the front and rear end faces thereof serving as protruding faces 11. As in case of first embodiment, when the spacer 9 is mounted and fixed to the indoor heat exchanger 4, the protruding faces 11 prevent the fins 6 from being deflected by a force applied from the outside.

Figure 7:
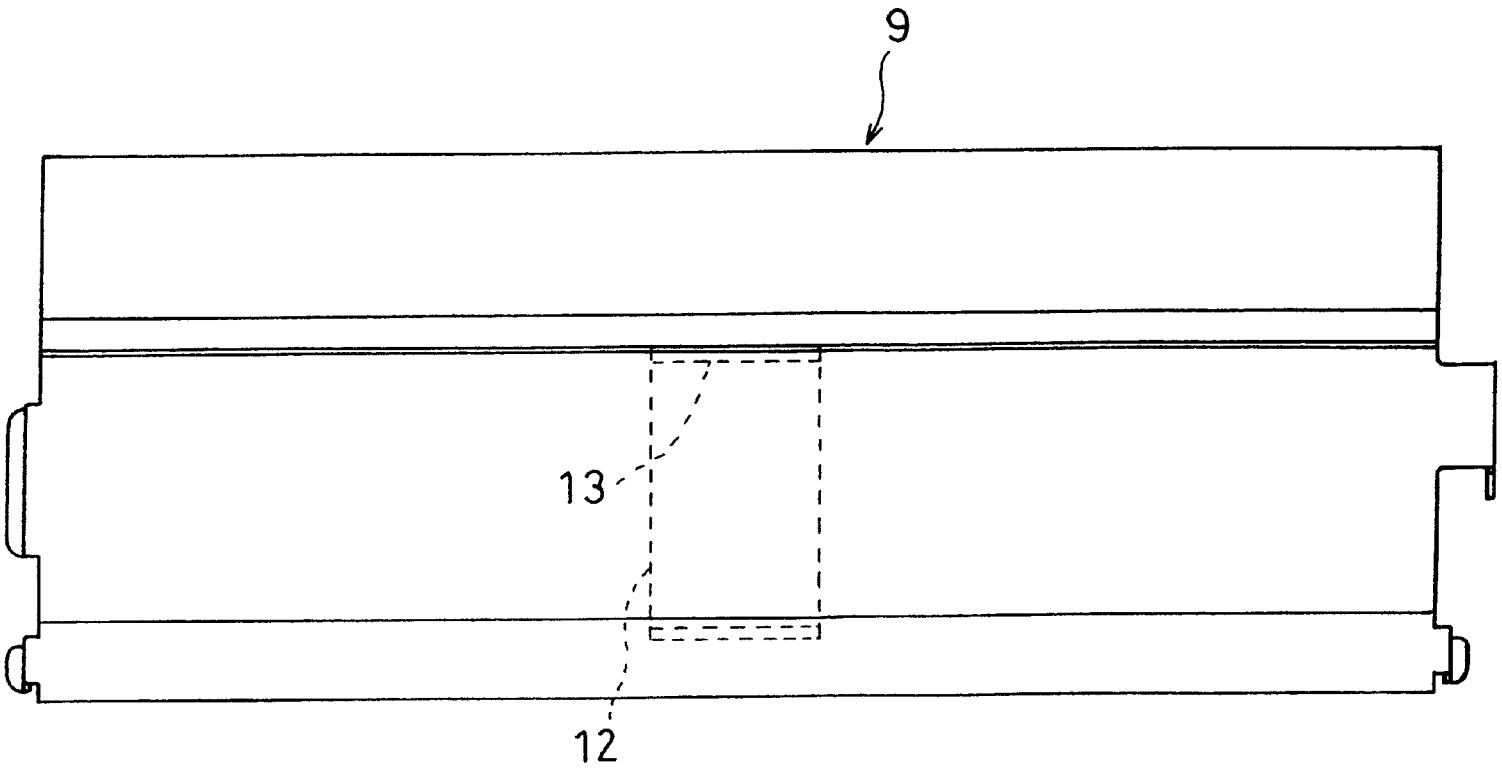
FIG. 7 is a plan view of a spacer for an indoor heat exchanger in accordance with a third embodiment of the present invention.
Figure 8:
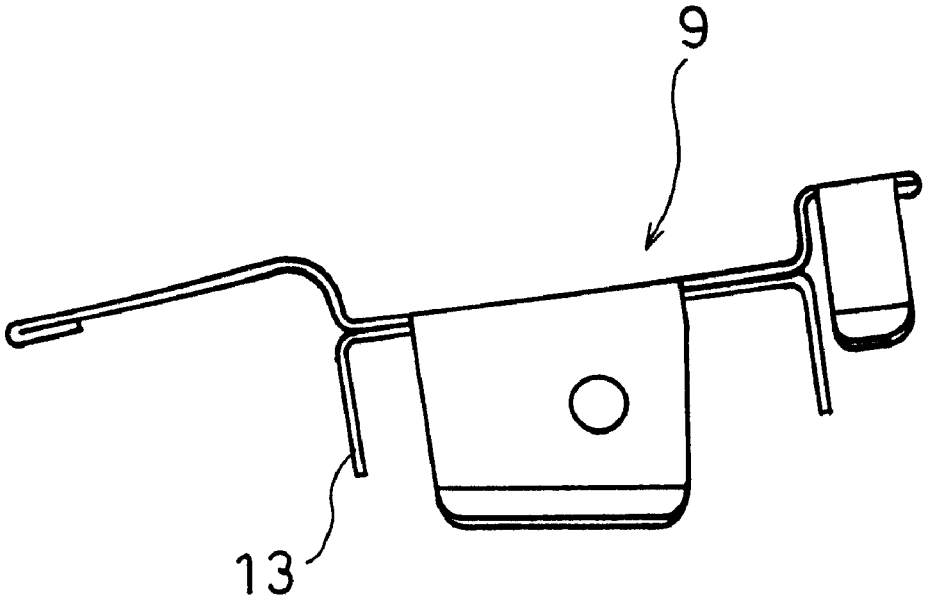
FIG. 8 is a side view of a spacer for the indoor heat exchanger.
Figure 9:
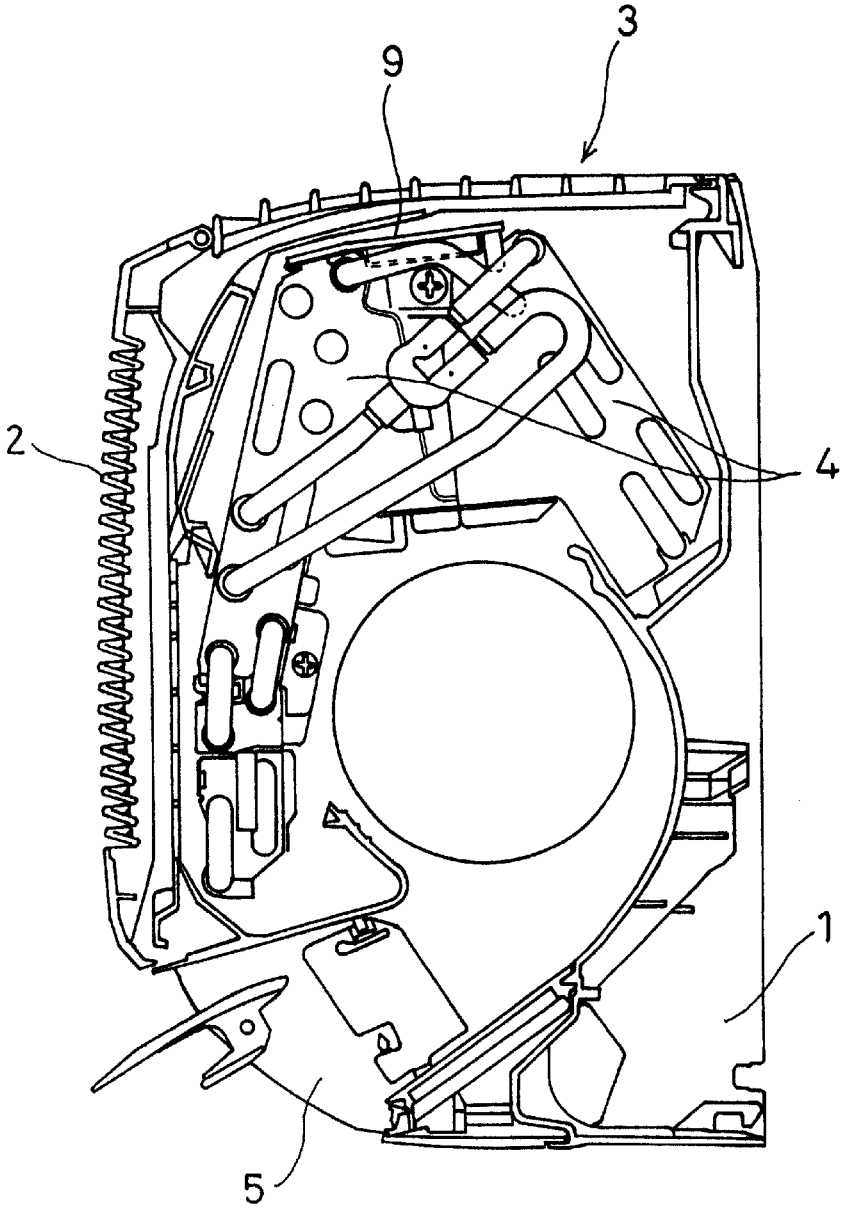
FIG. 9 PRIOR ART
FIG. 9 is a sectional view of an indoor unit for a conventional separate type air conditioner.
Figure 10:
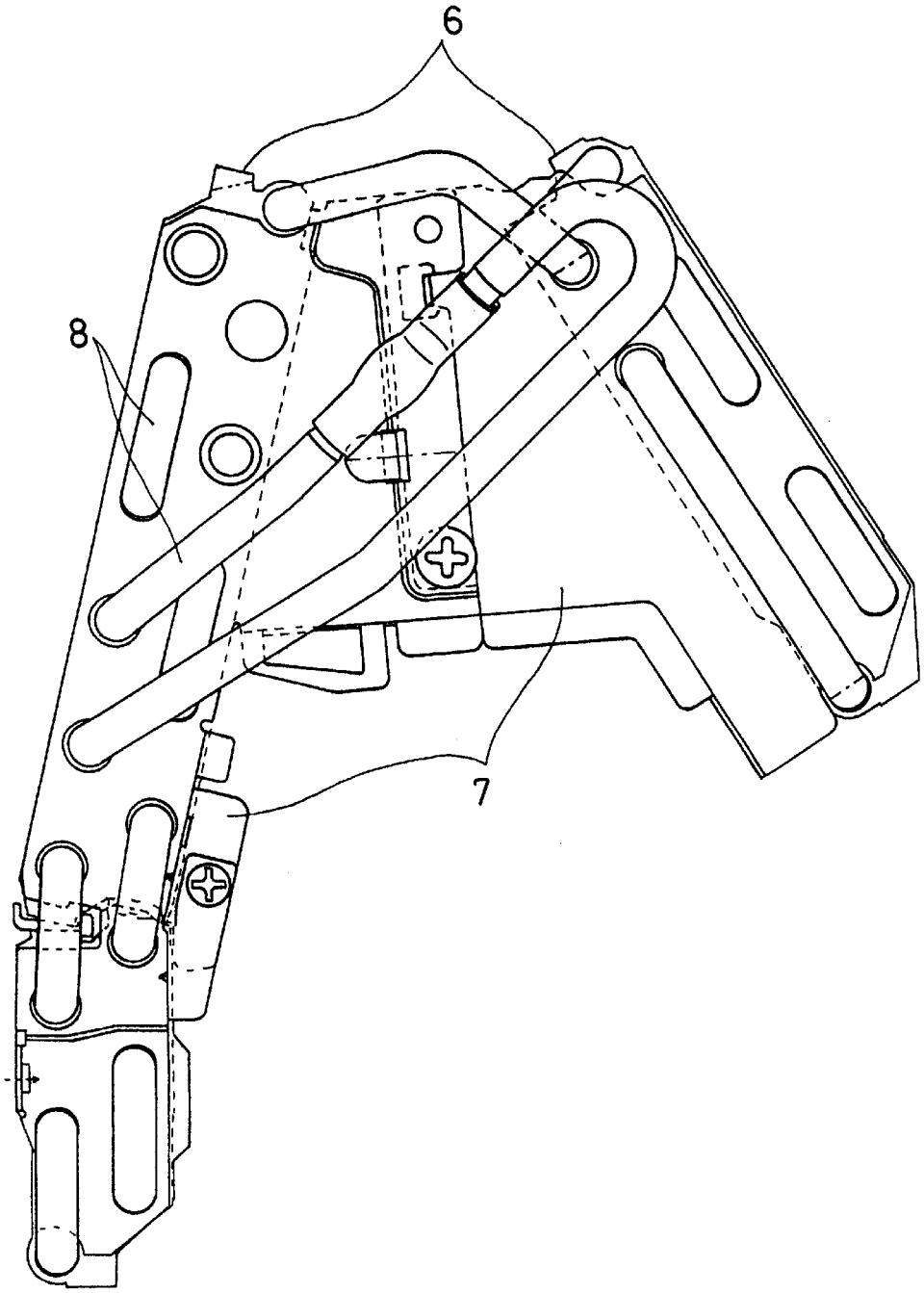
FIG.10 PRIOR ART
FIG. 10 is a side view of an indoor heat exchanger for the conventional separate type air conditioner.
Figure 11:
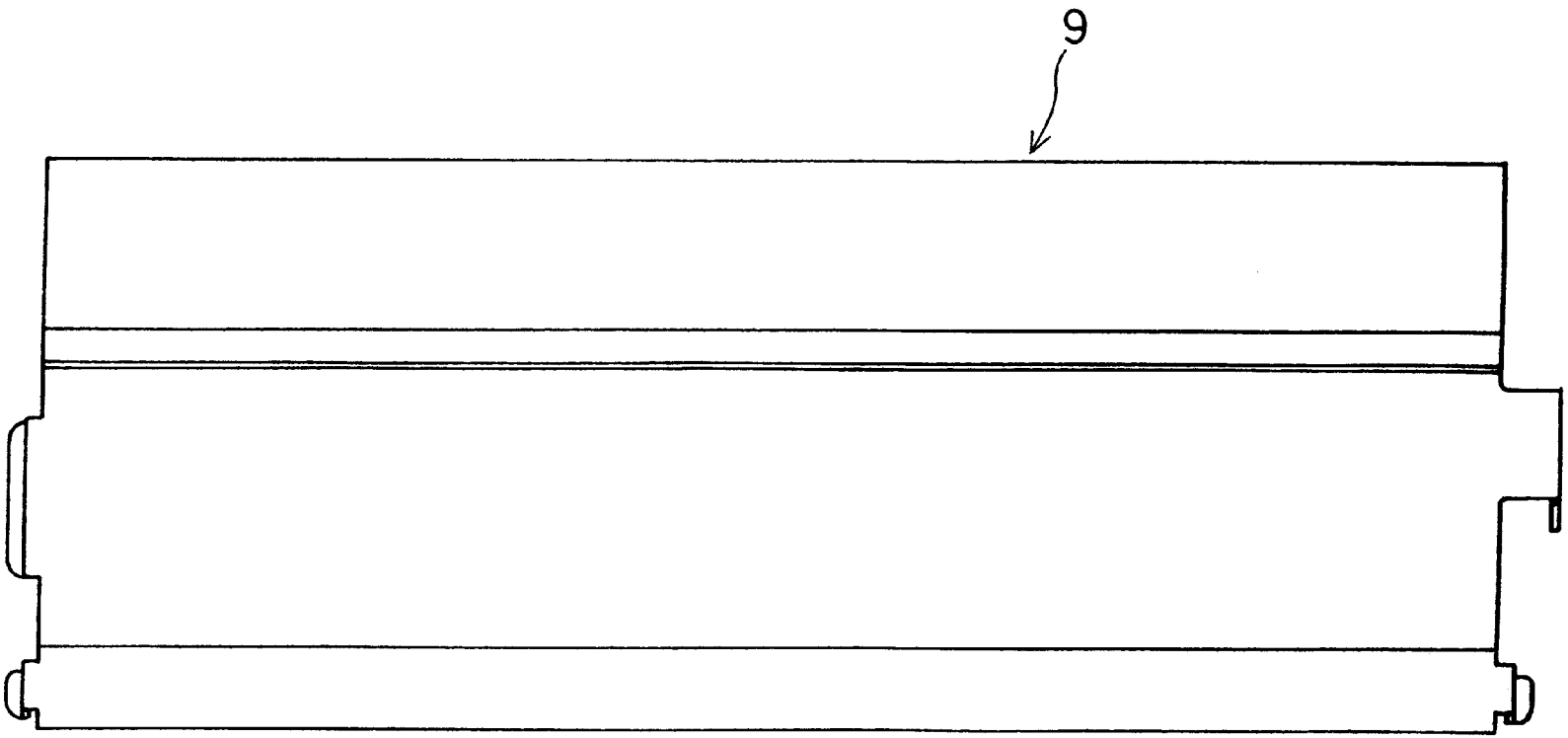
FIG.11 PRIOR ART
FIG. 11 is a plan view of a spacer for the indoor heat exchanger.
Figure 12:
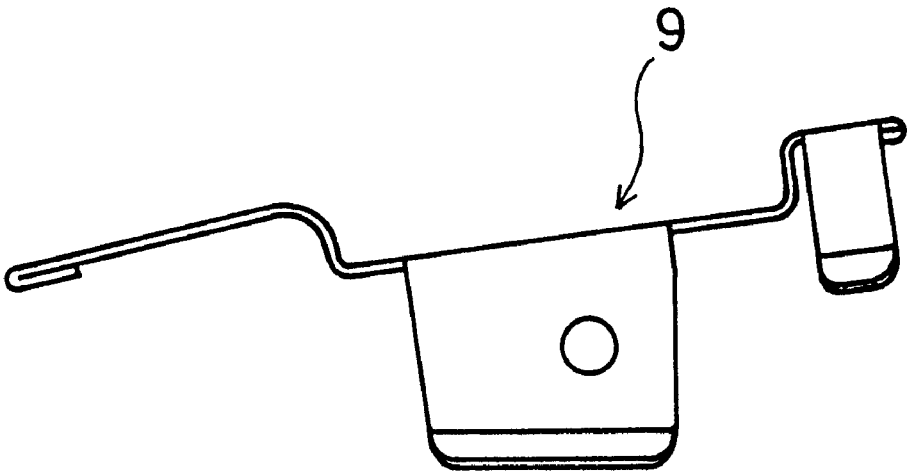
FIG.12 PRIOR ART
FIG. 12 is a side view of a spacer for the indoor heat exchanger.

Next, a spacer in accordance with a third embodiment of the present invention will be described with reference to FIGS. 7 and 8. For a spacer 9 shown in FIGS. 7 and 8, a separate U-shaped part 12 is mounted and fixed by welding or other means at the same position as that described in the first and second embodiments, thereby forming protruding faces 13 on the front and rear end faces thereof. As in cases of the first and second embodiments, when the spacer 9 is mounted and fixed to the indoor heat exchanger 4, the protruding faces 13 prevent the fins 6 from being deflected by a force applied from the outside.

As described above, according to the present invention, even if a shock is applied to the indoor heat exchanger for the separate type air conditioner from either side of front and rear, for example, in transport, the fins are prevented from being deflected toward the inside and being deformed, so that a possibility of adverse effects caused on the performance of the heat exchanger can be reduced significantly without an increase in the number of parts.

Also, by providing the spacer in which the protruding faces for preventing the deflection of fins are formed by cutting and bending or drawing, the fins can be prevented from being deflected toward the inside and being deformed by a force applied to the indoor heat exchanger from the outside without an increase in the number of parts and fabrication processes.

Also, by providing the spacer in which the protruding faces for preventing the deflection of fins are formed by mounting and fixing the separate part, the fins can be prevented from being deflected toward the inside and being deformed by a force applied to the indoor heat exchanger from the outside. Also, by preparing a plurality of the separate parts with a different shape, which are to be mounted and fixed, the flexibility of the spacer body is increased while keeping the commonality thereof, so that the spacer can be used for a plurality of indoor heat exchangers with different shapes. This method is more effective in the case where it is difficult to perform cutting and bending or drawing because the distance between the spacer and the fin is long.

What is claimed is:

1. A separate type air conditioner comprising:

an indoor unit comprising (a) an indoor air intake port in front thereof, (b) an indoor air blow-off port in a frontal lower portion thereof, (c) an indoor air circuit including an indoor heat exchanger and an indoor fan both being inside thereof, and (d) an indoor power source plate including a controller;

an outdoor unit comprising (a) an outdoor air circuit including an outdoor air intake port, an outdoor heat exchanger, an outdoor fan, and an outdoor air blow-off port, (b) refrigeration cycle parts including a compressor and a throttling device, and (c) an outdoor power source plate; and pipes and wires connecting said indoor unit to said outdoor unit to form a refrigeration cycle and an electric circuit;

said indoor heat exchanger being bent at an upper part thereof to be divided into front and rear portions and having a spacer provided as a closing plate on top of the bent portion to close a gap between the divided front and rear portions, wherein said spacer is provided with abutting means for preventing deflection of a fin of said indoor heat exchanger so that said abutting means is caused to abut on an upper inside of each of front and rear fins to achieve integral construction of the indoor heat exchanger.

2. The separate type air conditioner according to claim 1, wherein said abutting means comprises one or a plurality of protruding faces which project substantially perpendicularly downward of said spacer at or around a lengthwise center of said spacer on each front and rear sides thereof, so that the front-side protruding face is caused to abut on the upper inside of the front fin and the rear-side protruding face is caused to abut on the upper inside of the rear fin.

3. The separate type air conditioner according to claim 2, wherein said protruding faces of said spacer for preventing deflection of the fin are formed by cutting and bending part of a front portion and a rear portion of said spacer.

4. The separate type air conditioner according to claim 2, wherein said protruding faces of said spacer for preventing deflection of the fin are formed by integrally drawing said spacer.

5. The separate type air conditioner according to claim 2, wherein said protruding faces of said spacer for preventing deflection of the fin are formed by mounting and fixing a separate part to said spacer.

* * * * *